US011069499B2

(12) United States Patent
Su et al.

(10) Patent No.: US 11,069,499 B2
(45) Date of Patent: Jul. 20, 2021

(54) POWER-SAVING CIRCUIT FOR CONTACTOR

(71) Applicant: MORNSUN GUANGZHOU SCIENCE & TECHNOLOGY CO., LTD., Guangdong (CN)

(72) Inventors: Junxi Su, Guangdong (CN); Xiangyang Yin, Guangdong (CN)

(73) Assignee: MORNSUN GUANGZHOU SCIENCE & TECHNOLOGY CO., LTD., Guangdong (CN)

( * ) Notice: Subject to any disclaimer, the term of this patent is extended or adjusted under 35 U.S.C. 154(b) by 572 days.

(21) Appl. No.: 15/776,077

(22) PCT Filed: Aug. 30, 2016

(86) PCT No.: PCT/CN2016/097311

§ 371 (c)(1),
(2) Date: May 15, 2018

(87) PCT Pub. No.: WO2017/113843

PCT Pub. Date: Jul. 6, 2017

(65) Prior Publication Data

US 2020/0258707 A1 Aug. 13, 2020

(30) Foreign Application Priority Data

Dec. 31, 2015 (CN) ..... 201511034000.4

(51) Int. Cl.
*H01H 47/00* (2006.01)
*H01H 47/32* (2006.01)
*H01H 47/22* (2006.01)

(52) U.S. Cl.
CPC ..... *H01H 47/325* (2013.01); *H01H 47/223* (2013.01)

(58) Field of Classification Search
CPC ..... H01H 47/325; H01H 47/223
See application file for complete search history.

(56) References Cited

U.S. PATENT DOCUMENTS 4,516,185 A * 5/1985 Culligan ..... H01H 47/04 361/154
6,771,479 B2 * 8/2004 Vanheesbeke ..... D03C 3/20 361/152
2003/0123212 A1 * 7/2003 Dunk ..... H01H 47/325 361/160

FOREIGN PATENT DOCUMENTS

CN 1925085 3/2007
CN 201044229 4/2008
(Continued)

OTHER PUBLICATIONS

"International Search Report (Form PCT/ISA/210)", dated Dec. 5, 2016, with English translation thereof, pp. 1-4.

*Primary Examiner* — Thienvu V Tran
*Assistant Examiner* — Sreeya Sreevatsa
(74) *Attorney, Agent, or Firm* — JCIPRNET

(57) ABSTRACT

A power-saving circuit for a contactor includes a coil drive circuit, and further includes a rectification and filtering circuit, a PFC circuit, an auxiliary power supply circuit, and a square wave generation circuit. The square wave generation circuit outputs a first square wave signal to the PFC circuit via a first output end according to a set timing sequence, and outputs a second square wave signal and a third square wave signal to the coil drive circuit via a second output end, so as to respectively control duty cycles of a first switch tube in the PFC circuit and a second switch tube in the coil drive circuit. The auxiliary power supply circuit supplies electric energy to the square wave generation circuit during a holding stage of the contactor. The rectification and filtering circuit is used for rectifying an input AC
(Continued)

into a pulsating DC, and filtering an input narrow-pulse current into a smooth current to be outputted to the PFC circuit after eliminating higher harmonic components other than a fundamental frequency component of 50 Hz. The PFC circuit receives rectified and filtered electric energy, enables an effective value of the input current to change along with an input voltage, and outputs the input current to the coil drive circuit and the auxiliary power supply circuit. The coil drive circuit is used for controlling the current of a contactor coil. Wherein during a pull-in stage of the contactor, the PFC circuit does not work and the power-saving circuit provides a large current to the contactor coil to pull in; during a transition stage, the PFC circuit starts to work and the power-saving circuit controls the current of the contactor coil to decrease gradually; and during a holding stage of the contactor, the PFC circuit keeps working and the power-saving circuit controls the current of the contactor coil to be kept as a small current required for holding.

20 Claims, 10 Drawing Sheets

(56) References Cited

FOREIGN PATENT DOCUMENTS

| | | | |
|---|---|---|---|
| CN | 101752143 | | 6/2010 |
| CN | 102709118 | | 10/2012 |
| CN | 204835966 U | * | 12/2015 |
| CN | 105551885 | | 5/2016 |
| CN | 205406395 | | 7/2016 |
| DE | 3339271 | | 5/1985 |

* cited by examiner

POWER-SAVING CIRCUIT FOR CONTACTOR

CROSS-REFERENCE TO RELATED APPLICATION

This application is a 371 application of the international PCT application serial no. PCT/CN2016/097311, filed on Aug. 30, 2016, which claims the priority benefit of China application no. 201511034000.4, filed on Dec. 31, 2015. The entirety of each of the abovementioned patent applications is hereby incorporated by reference herein and made a part of this specification.

BACKGROUND

Technical Field

The invention relates to the field of AC contactors, in particular to a power-saving circuit for an AC contactor with increased power factor.

Description of Related Art

A traditional contactor operated system consists of a coil, a static iron core, an armature, and a counterforce spring. An attractive force is generated between the static iron core and the armature when the contactor coil is energized. When the attractive force is greater than the spring reactive force, the armature is attracted to the static iron core until it contacts the static iron core. At this time, the primary contact is closed, and the process is called pulling-in process. The process in which the coil is continuously energized, the armature is kept in contact with the static iron core, and the primary contact remains closed is called holding process. When the current in the coil is reduced or interrupted, the attractive force of the static iron core to the armature is reduced. The process in which the armature returns to the open position when the attractive force is smaller than the spring reactive force, and the primary contact is separated is called release process.

The contactor is used for frequently switching on and off the alternating current (AC) and direct current (DC) circuits and the low voltage electrical appliances that can be controlled remotely. It is mainly used for controlling the electric motors as well as electric loads such as electric heaters, electric welders, and illuminating lamps. At present, contactors are greatly used all over China. When the medium and large-capacity contactors are in the holding state, the average active power consumed by each unit is about 60 W, and the power factor is only about 0.3. Reducing the energy consumption of contactors contributes a lot to energy saving and emission reduction.

Existing contactor power savers adopt AC to DC, high-current pulling in, and low-current holding methods, which greatly reduces electromagnetic coils' core losses, winding losses and short-circuit ring loss, and can reduce active power consumption by more than 90%. However, these technologies have certain drawbacks of only solving the problem of active power consumption rather than power factor improvement. Some power-saving technologies also reduce the power factor. For example, in the patent application No. 200510029373.2, a pulse form is used to power the electromagnetic coil so that the electromagnetic coil operates with a constant small current; when operating in such a manner, not only a large number of harmonics are generated, but also the effective values of the input current will not follow the input voltage, resulting in an extremely low power factor. A prototype manufactured by this technique have an actual PF value being smaller than 0.3. According to patented technologies of application numbers 201210196762.4 and 201010040019.0, the electromagnetic coil is excited when the input AC voltage is just over zero, so that the input current and output voltage is similar to an inverted state. A prototype is manufactured by this technique, with the power factor being smaller than 0.1.

In the national standard GB21518-2008, there are three levels of energy efficiency for the contactor coil losses. Conventional contactors are of the third level of energy efficiency, while the contactors with power-saving technologies can achieve the second level of energy efficiency. For a contactor with a capacity of more than 100 A, it is necessary to reduce the coil holding power consumption to 1 VA or less in order to achieve the primary level of energy efficiency. The vast majority of current contactor power-saving technologies do not consider the problem of power factor. It is difficult to achieve the primary level of energy efficiency by using the existing power-saving technologies. Power factor correction (PFC) circuits must be used to achieve the primary energy efficiency. For the contactor-related field, no active PFC technology has been found to improve the power factor of the contactor coil. The active PFC is a new technology for those skilled in the contactor field. In the field of switching power supplies, with the requirements of relevant industry standards, active PFC circuits are generally used in switching power supplies with a power level of 75 W or more. Because of the cost, it is not used in low-power switching power supplies, not to mention the micro-power switching power supplies below 1 W. Normally, high-power PFCs operate in continuous or critical mode, while low-power PFCs operate in discontinuous mode. The difference is very large. The operating principle and process of the PFC circuit with a power level of 1 W or less are different from those of a high-power PFC circuit. Therefore, for those skilled in the switching power supply field, a PFC technology with a power level of 1 W or less is not commonly used.

In view of the above-mentioned defects in the prior art, the present invention provides a power-saving circuit of an AC contactor, which can increase the power factor while reducing the active power consumption of the contactor coil, so that the conventional contactor achieves the primary level of energy efficiency.

SUMMARY

The technical problem to be solved by the present invention is to provide a power-saving circuit for a contactor which can increase the power factor while reducing the active power consumption of the contactor coil.

In order to achieve the above objective, the present invention provides a power-saving circuit for a contactor, including a coil drive circuit, further including a rectification and filtering circuit, a PFC circuit, an auxiliary power supply circuit, and a square wave generation circuit. The square wave generation circuit outputs a first square wave signal to the PFC circuit via a first output end according to a set timing sequence, and outputs a second square wave signal and a third square wave signal to the coil drive circuit via a second output end, so as to respectively control duty cycles of a first switch tube in the PFC circuit and a second switch tube in the coil drive circuit. The auxiliary power supply circuit supplies electric energy to the square wave generation circuit during a holding stage of the contactor. The rectification and filtering circuit is used for rectifying an input AC into a pulsed DC, and filtering an input narrow-pulse current into a smooth current to be outputted to the PFC circuit after eliminating higher harmonic components other than a fundamental frequency component of 50 Hz. The PFC circuit receives rectified and filtered electric energy, enables an effective value of the input current to change along with an input voltage, and outputs the input current to the coil drive circuit and the auxiliary power supply circuit. The coil drive circuit is used for controlling the current of a contactor coil. During a pull-in stage of the contactor, the PFC circuit does not work and the power-saving circuit provides a large current to the contactor coil to pull in. During a transition stage, the PFC circuit starts to work and the power-saving circuit controls the current of the contactor coil to decrease gradually. During a holding stage of the contactor, the PFC circuit keeps working and the power-saving circuit controls the current of the contactor coil to be kept as a small current required for holding.

Preferably, the rectification and filtering circuit includes an inductor, and the PFC circuit includes a transformer, wherein the inductor of the rectification and filtering circuit and the selection parameter of the transformer of the PFC circuit are designed according to the power of the contactor holding stage. During the contactor pull-in stage, both the inductor and the transformer are in a saturation state.

Preferably, the set timing sequence of the square wave generation circuit is as follows: during a contactor pull-in stage, the first output end is controlled not to output a first square wave signal to the first N-type metal-oxide-semiconductor (N-MOS) transistor of the PFC circuit, so that the PFC circuit is in a non-working state; and a second square wave signal of a large duty cycle is outputted to the second N-MOS transistor of the coil drive circuit through the second output end; during a transition stage, a first square wave signal begins to be outputted to the first N-MOS transistor of the PFC circuit through the first output end, so that the PFC circuit starts to work; and a third square wave signal of a small duty cycle is outputted to the second N-MOS transistor of the coil drive circuit through the second output end; during a holding stage of the contactor, a first square wave signal is continuously outputted to the first N-MOS transistor of the PFC circuit through the first output end, so as to control the PFC circuit to continuously work; and a third square wave signal of a small duty cycle is continuously outputted to the second N-MOS transistor of the coil drive circuit through the second output end, so as to control the current of the contactor coil to be kept as a small current required for holding.

Preferably, the large current provided by the power-saving circuit during the pull-in stage of the contactor is 10 to 20 times the small current during the holding stage.

Preferably, the rectification and filtering circuit includes an inductor, a rectifying bridge and a first capacitor which are connected in such a relationship that the inductor is connected in series between the input end of the AC and the input end of the rectifying bridge, and the output end of the rectifying bridge and the first capacitor are connected in parallel to lead out as the output end of the rectification and filtering circuit.

Preferably, the PFC circuit includes a transformer, a first N-MOS transistor, a second diode, and a third capacitor. The transformer includes a primary winding and a secondary winding which are connected in such a relationship that the dotted end of the primary winding are connected to the output ends of the rectification and filtering circuit, the non-dotted end of the primary winding are respectively connected to the drain electrode of the first N-MOS transistor and the anode of the second diode. The cathode of the second diode is grounded via a third capacitor, and the cathode of the second diode is also led out as the output end of the PFC circuit; the gate of the first N-MOS transistor is connected to the first output end of the square wave generation circuit, and the source electrode of the first N-MOS transistor is grounded; the secondary winding is connected to the auxiliary power supply circuit.

Preferably, the PFC circuit includes a transformer, a first N-MOS transistor, a second diode, and a third capacitor. The transformer includes a primary winding and a secondary winding which are connected in such a relationship that the drain electrodes of the first N-MOS transistor are connected to the output ends of the rectification and filtering circuit, and the source electrode of the first N-MOS transistor are respectively connected to the dotted end of the primary winding and the cathodes of the second diode, and the non-dotted end of the primary winding are grounded via a third capacitor; the non-dotted end of the primary winding is also led out as the output end of the PFC circuit; the anode of the second diode is grounded; the gate of the first N-MOS transistor is connected to the first output end of the square wave generation circuit; the secondary winding is connected to the auxiliary power supply circuit.

Preferably, the square wave generation circuit includes a first input end, a second input end, a first output end, and a second output end which are connected in such a relationship that the first input end is connected to the input end of the PFC circuit to provide electric energy required for the first start-up of the square wave generation circuit; the second input end is connected to the output end VDD of the auxiliary power supply circuit to provide electric energy for the square wave generation circuit during a transition stage and the holding stage; the first output end is connected to the PFC circuit to output the first square wave signal to control the transmission energy of the PFC circuit; the second output end is connected to the coil drive circuit to adjust the current of the contactor coil by changing the duty cycle of the square wave signal.

Preferably, the auxiliary power supply circuit is composed of a first diode and a second capacitor which are connected in such a relationship that the anode of the first diode is connected to the PFC circuit, and the cathode of the second diode is grounded via the second capacitor. The cathode of the second diode is also led out as the output end VDD of the auxiliary power supply circuit.

Preferably, the coil drive circuit is composed of a third diode and a second N-MOS transistor which are connected in such a relationship that the cathode of the third diode is connected to the output end of the PFC circuit, and the cathode of the third diode is also led out as the output positive end of the coil drive circuit for being connected to one end of the contactor coil; the anode of the third diode is connected to the drain electrode of the second N-MOS transistor, and the drain electrode of the second N-MOS transistor is also led out as the output negative end of the coil drive circuit for being connected to the other end of the contactor coil; the gate of the second N-MOS transistor is connected to the second output end of the square wave generation circuit, and the source electrode of the second N-MOS transistor is grounded.

Compared with the prior art, the beneficial effect of the present invention is as follows: the power factor of the power-saving circuit is significantly improved, and the PF value of originally less than 0.3 is increased to 0.9 or more. So that the contactor energy consumption can be reduced to below 1 VA, to meet the primary level of energy efficiency of the national standard GB21518-2008.

DETAILED DESCRIPTION OF THE EMBODIMENTS

In order to better understand the improvements made by the present invention relative to the prior art, before describing the two specific embodiments of the present invention in detail, the current technology mentioned in the background art will be described first, from which the inventive concept of the present application will be derived.

Due to the fact that the coil of the existing contactor needs a large current during the pull-in process, and the current required by the coil during the holding process is rather small, the pull-in current is usually 10 to 20 times the holding current. In the circuit design, in order to reduce the cost and volume, the first inductor and the first transformer are designed according to the holding power, so during the pull-in process, the first inductor and the first transformer are all in a saturation state, and the PFC circuit cannot operate normally. Therefore, the first output end of the square wave generation circuit does not output a square wave signal when energized for the first time, and the PFC circuit does not work. The second output end of the square wave generation circuit outputs a square wave signal with a relatively large duty cycle, so that a large current flows through the coil, and the contactor is in a pull-in state at this time. After a certain time of delay (preferably, the selectable delay time is 100 ms), the first output end of the square wave generation circuit outputs a square wave signal to control the normal working of the PFC circuit; the second output end outputs a square wave signal with a relatively small duty cycle, so that the current flowing through the coil gets smaller, the active power loss of the contactor coil is reduced, and the contactor enters the holding process.

Conventional power factor correction circuits are commonly used for power supplies of several tens of watts or more, and are usually operated in a critical or continuous mode. The power level of the PFC circuit is less than 1 W, and there is a clear technical difference compared with the conventional power factor correction circuit. The PFC circuit operates in a discontinuous mode with a rather small duty cycle (preferably, the first output end square wave frequency of the square wave generation circuit is 100 kHz and the duty cycle is 1%). With such a small duty cycle, although the effective value of the input current varies with the input voltage, the current is a narrow-pulse current which has a large high-frequency harmonic component and the PF value is not higher than 0.3. The first inductor and the first capacitor act as a filter filtering the narrow-pulse current to a smooth current, and the PF value can be as high as 0.9.

Based on this idea, the principle and implementation of the invention will be described in detail below with reference to the accompanying drawings.

The First Embodiment

Figure 1:
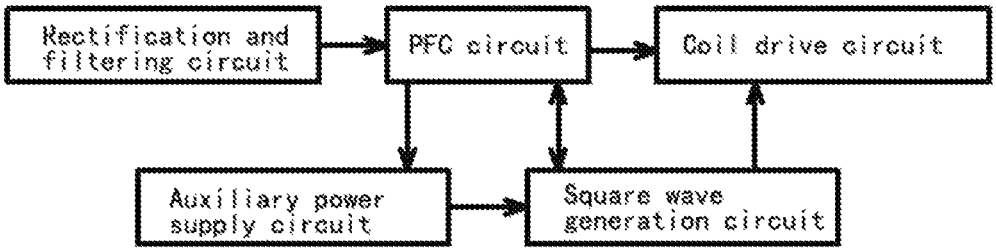
FIG. 1 is a schematic block circuit diagram of a power-saving circuit for a contactor according to a first embodiment of the present invention.
Figure 2:
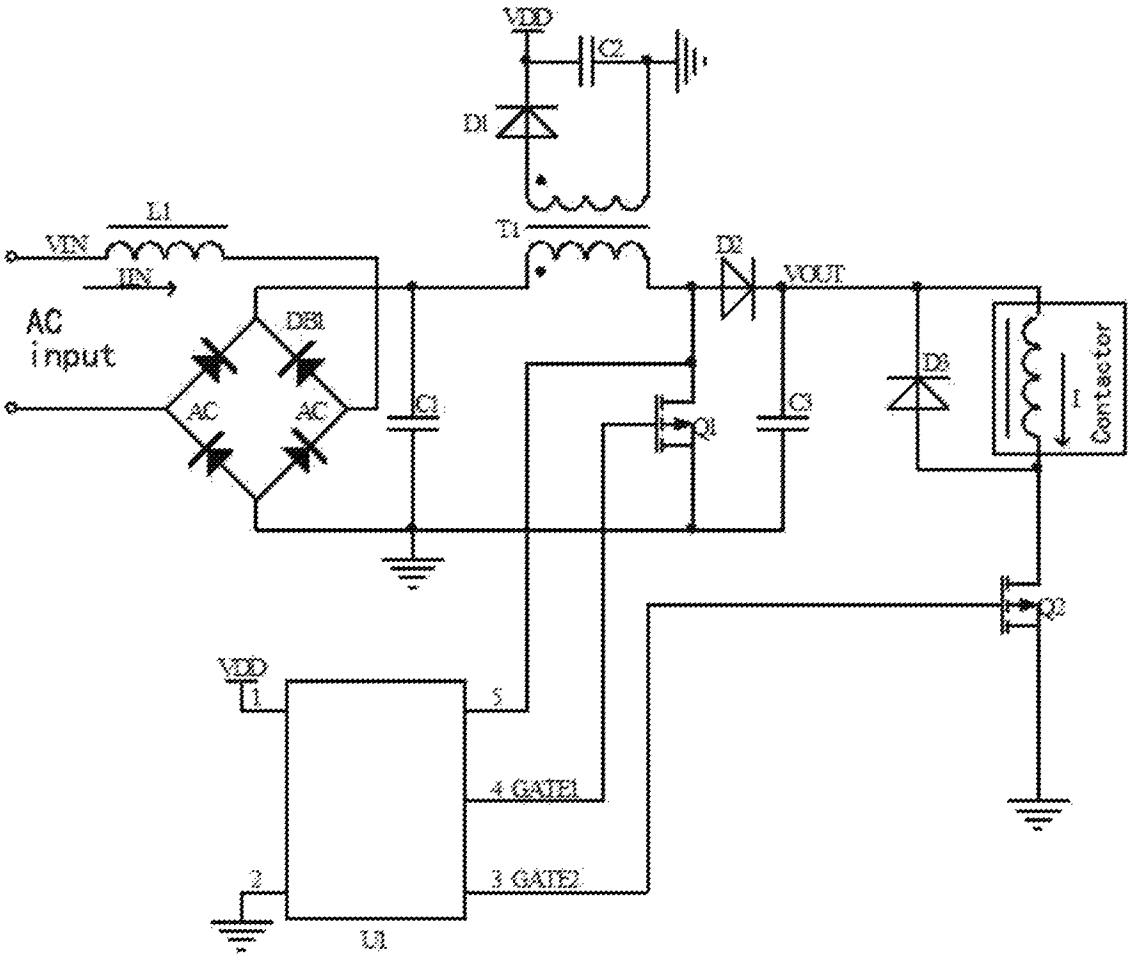
FIG. 2 is a schematic circuit diagram of a power-saving circuit for a contactor according to the first embodiment of the present invention.

FIG. 1 shows a schematic block circuit diagram of a power-saving circuit for a contactor according to a first embodiment of the present invention, following the connection relationship of the above-mentioned initial technical solution. A power-saving circuit for an AC contactor includes a rectification and filtering circuit, a PFC circuit, an auxiliary power supply circuit, a coil drive circuit, and a square wave generation circuit. The coil drive circuit is used for controlling the current of a contactor coil. The PFC circuit has a function to allow the effective value of the input current to vary with the input voltage. If there is no filtering action of the rectification and filtering circuit, the input current is a narrow-pulse current and the harmonic components are large, even if the effective value of the input current varies with the input voltage, the PF value is not high. The rectification and filtering circuit has two functions. The first is to rectify the input AC into a pulsed DC. The second is to filter the input narrow-pulse current into a smooth current, and the PF value is relatively high. The square wave generation circuit outputs a square wave signal to the PFC circuit and the coil drive circuit to control the current of the contactor coil and the output voltage of the PFC circuit. The actual implementation of the circuit diagram is as shown in FIG. 2.

Inductor L1, rectifying bridge DB1 and capacitor C1 form a rectification and filtering circuit. L is connected in series between the AC and DB1 input. DB1 output end is connected in parallel with C1, and DB1 output end is connected to the output end of the rectification and filtering circuit. The rectification and filtering circuit has two functions. The first function is to convert the input AC to the pulsating DC. The second is to filter the input pulse current to be smooth.

Figure 3:
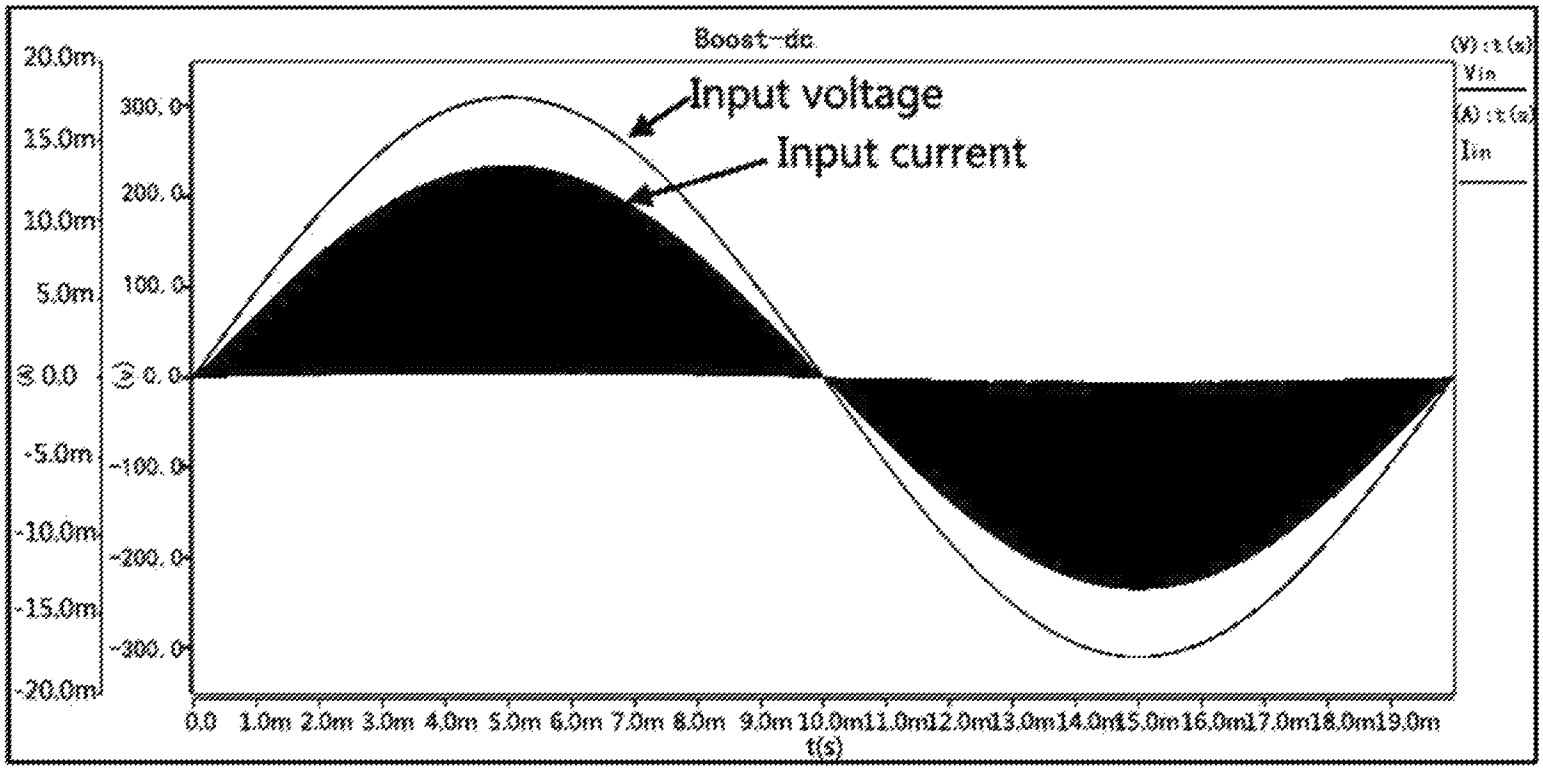
FIG. 3 is an unfiltered input current and voltage waveform of power-saving circuit of the contactor according to the first embodiment of the present invention.
Figure 4:
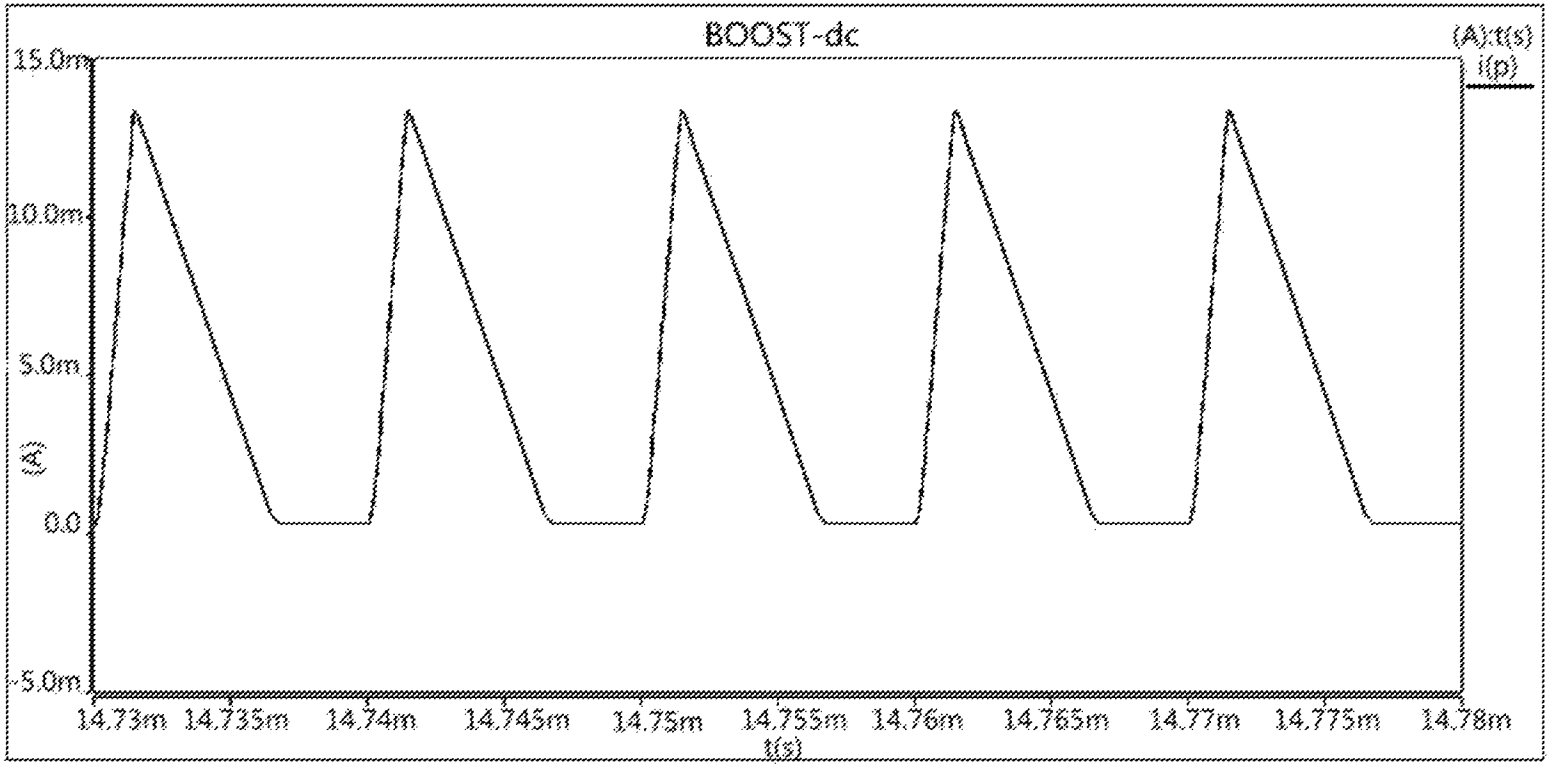
FIG. 4 is a partial enlarged view of the current waveform in FIG. 3.
Figure 5:
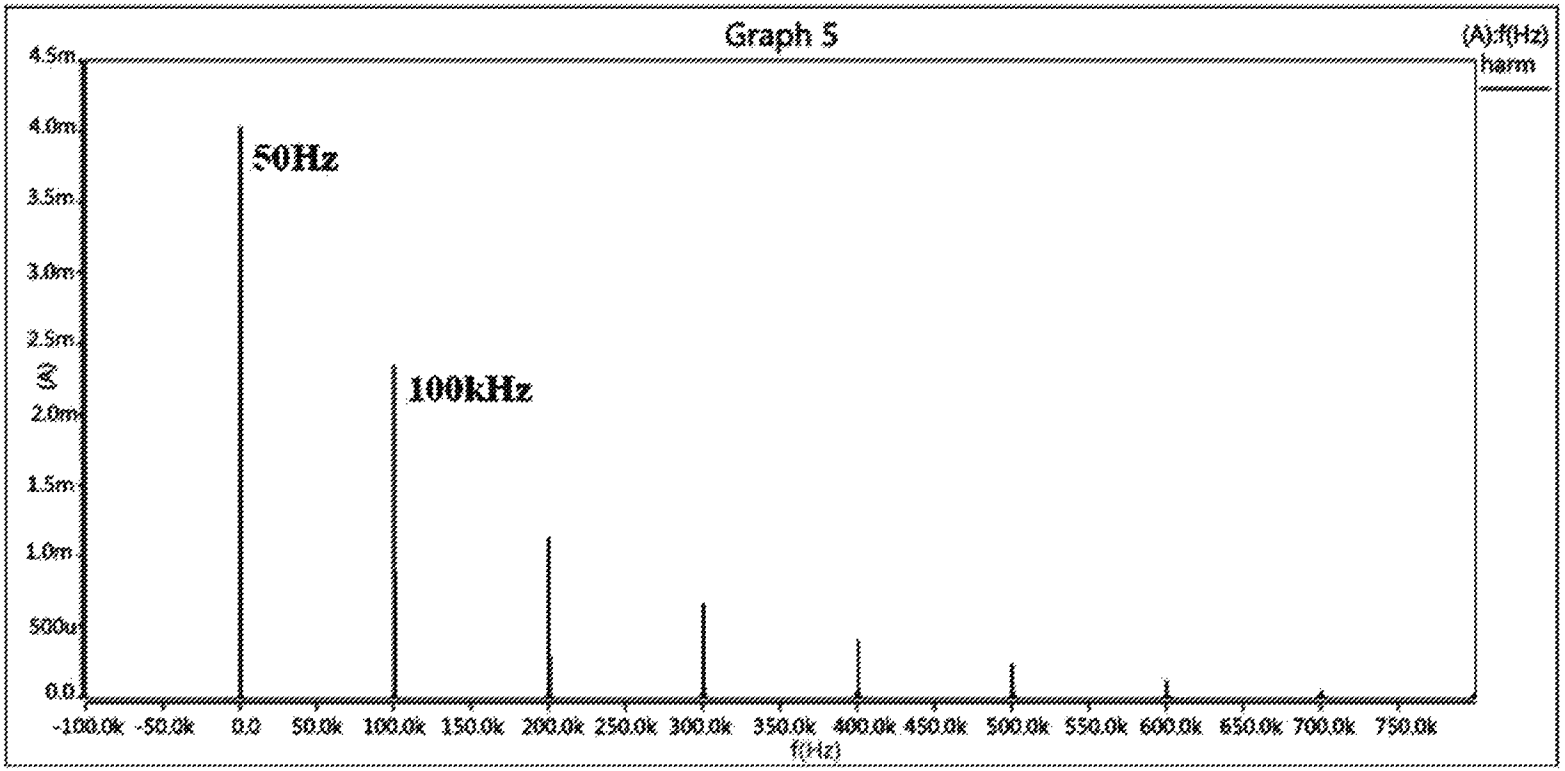
FIG. 5 is a spectrum diagram of the input current in FIG. 3.
Figure 6:
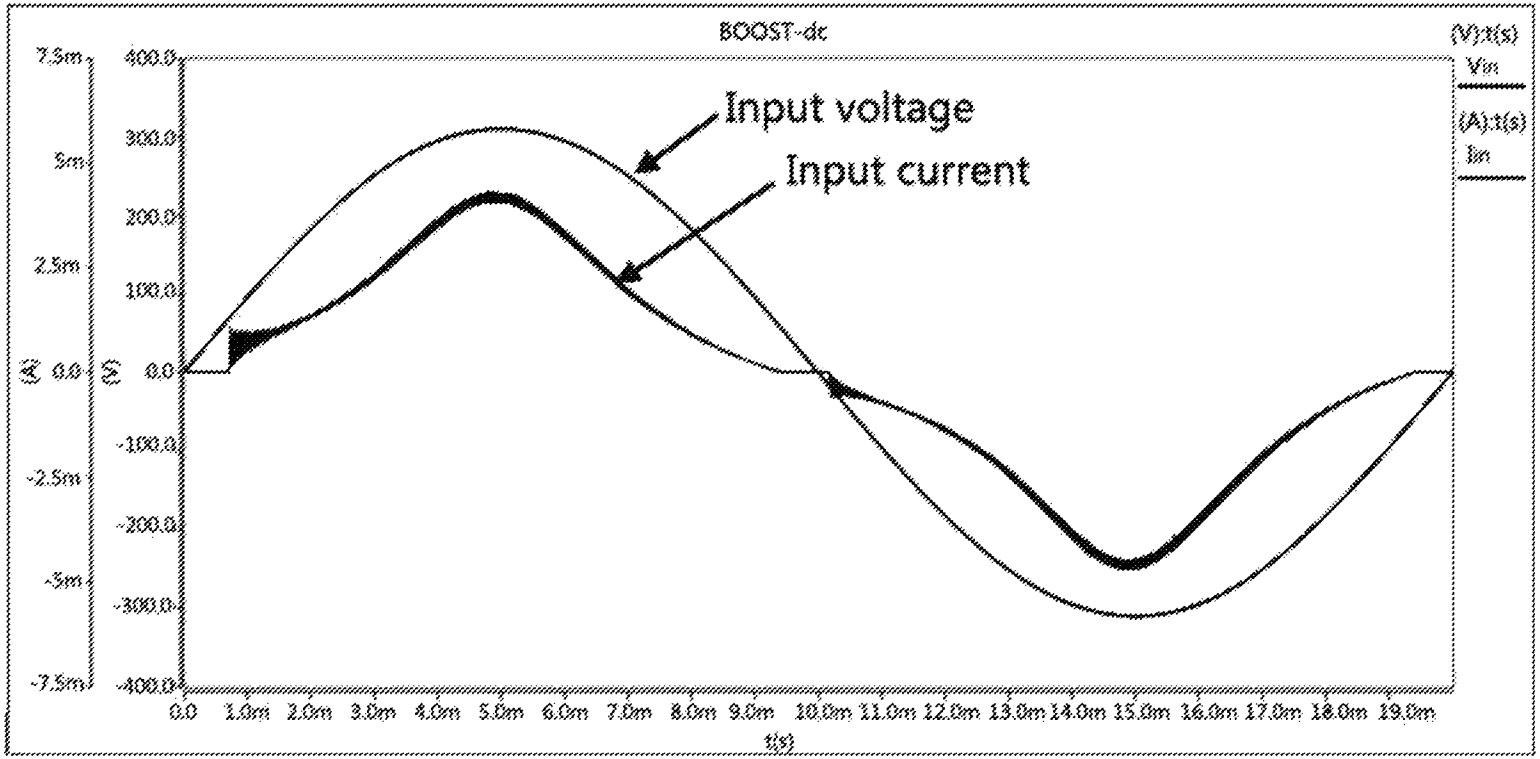
FIG. 6 is a filtered input current and voltage waveform according to the first embodiment of the present invention.
Figure 7:
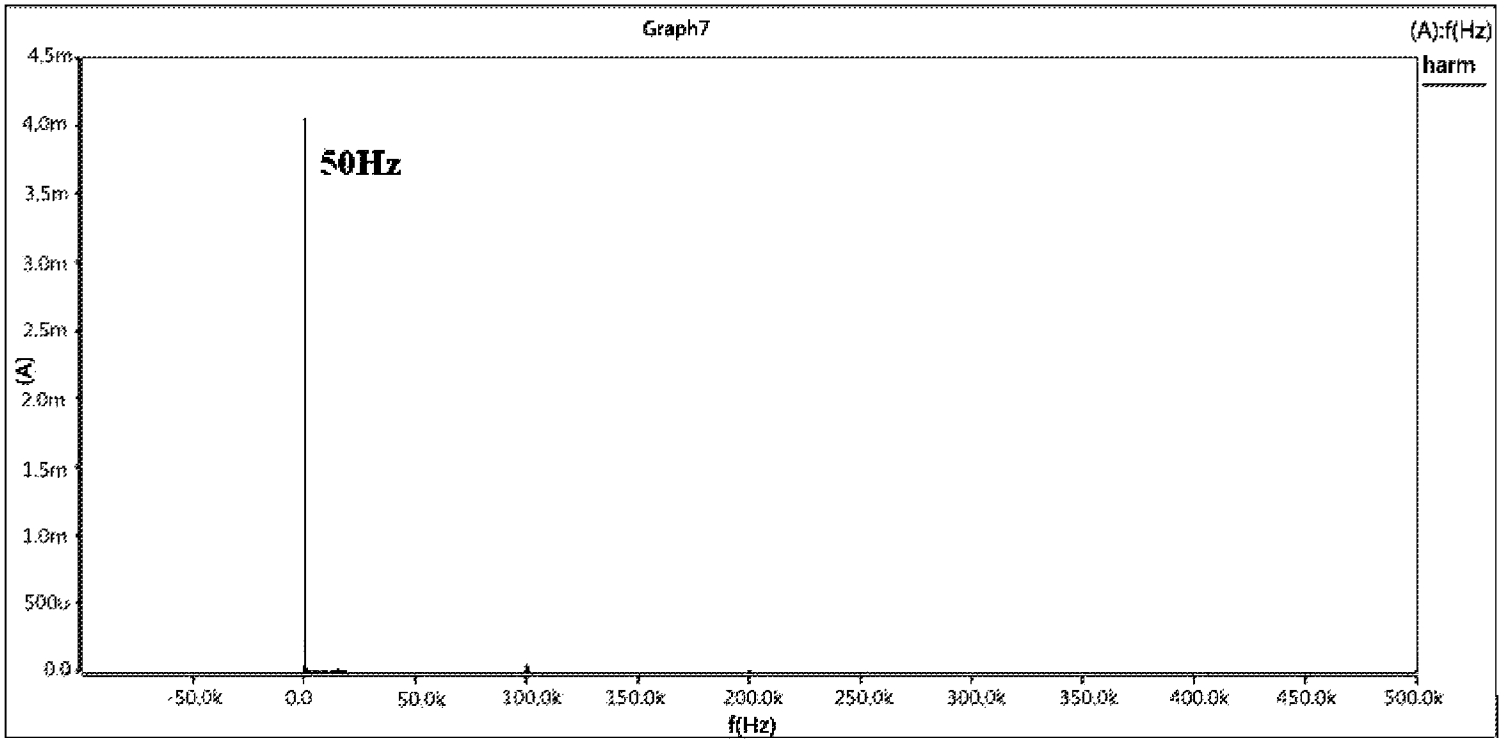
FIG. 7 is a spectrum diagram of the input current in FIG. 6.

The transformer T1, the N-MOS transistor Q1, the diode D2 and the capacitor C3 form a PFC circuit, wherein the transformer T1 includes a primary winding and a secondary winding. The dotted end of the primary winding are connected to the positive ends of the capacitor C1, and the non-dotted end of the primary winding are respectively connected to the drain electrode of the N-MOS transistor Q1 and the anode of the diode D2. The source electrode of the N-MOS transistor Q1 is grounded, and the diode cathode D2 is grounded via the capacitor C3. The PFC circuit has a function to allow the effective value of the input current vary with the input voltage. Unlike the power factor correction circuit that generally operates in a continuous or critical mode, since the circuit output power of the patent solution is less than 1 W, in order to reduce the volume and cost of the transformer T1, the inductance of the primary winding is not large, so the PFC circuit will operate in a discontinuous mode. In order to more clearly illustrate the function of the PFC circuit in this patent, a set of actual parameters are given as an example. For example, the frequency of the gate drive signal of the N-MOS transistor Q1 is 100 kHz and the duty cycle is 8%, and the transformer T1 primary winding inductance is 30 mH, and the input AC frequency is 50 Hz. The inductor L1 is short circuited, so that the capacitor C1 is open circuited to get the waveform of the input current and output voltage in a power frequency cycle in FIG. 3. The current waveform of FIG. 3 is amplified to obtain the input current waveform of FIG. 4 within a single switching cycle. It is seen from the figure that the input current is discontinuous. The harmonic component map of FIG. 5 can be obtained after performing Fourier decomposition on the current of FIG. 3. As can be seen from FIG. 5, in addition to the 50 Hz fundamental frequency component, there are 100 kHz components and other higher harmonic components. It can be seen from FIG. 3 to FIG. 5 that as for the PFC operating in the discontinuous mode, although the effective value of the input current varies with the input voltage, the input current is discontinuous and contains many high-frequency harmonic components, and the actual PF value is not high. The actual prototype test is only about 0.3. The function of the inductor L1 capacitor C1 is to eliminate high-frequency components above 100 kHz of the input current. The inductor L1 takes a value of 40 mH and the capacitor C1 takes a value of 2.7 nF. The input voltage and current waveforms in FIG. 6 are obtained. It can be seen from the figure that the input current has become smooth. The harmonic component map of FIG. 7 can be obtained after performing Fourier decomposition on the input current waveform of FIG. 6. It can be seen from FIG. 7 that most of the harmonic components above 100 kHz have been removed, leaving only 50 Hz of the fundamental frequency component, which can make the PF value rather high. The actual prototype test PF value can reach 0.9.

Diode D1 and capacitor C2 form an auxiliary power supply circuit. The anode of the diode D1 is connected to the dotted end of the secondary winding of the transformer T1. The cathode of the diode D1 is grounded via the capacitor C2, and the non-dotted end of the transformer T1 secondary winding is grounded.

The diode D3, the N-MOS transistor Q2 and the contactor coil form a coil drive circuit. The cathode of the diode D3 is connected to the cathode of the diode D2, the anode of the diode D3 is connected to the drain electrode of the N-MOS transistor Q2, the source electrode of the N-MOS transistor Q2 is grounded, and the contactor coil is connected in parallel with the diode D3. When the N-MOS transistor Q2 is conducted, the contactor coil is excited and the coil current increases; when the N-MOS transistor Q2 is turned off, the contactor coil freewheels through the diode D3 and the coil current decreases. In general, the inductance of the contactor coil is very large, and the current ripple of the coil is very small. It can be approximately considered that the coil current is constant in a steady state. The contactor coil current can vary with the duty cycle of the N-MOS transistor.

Figure 8:
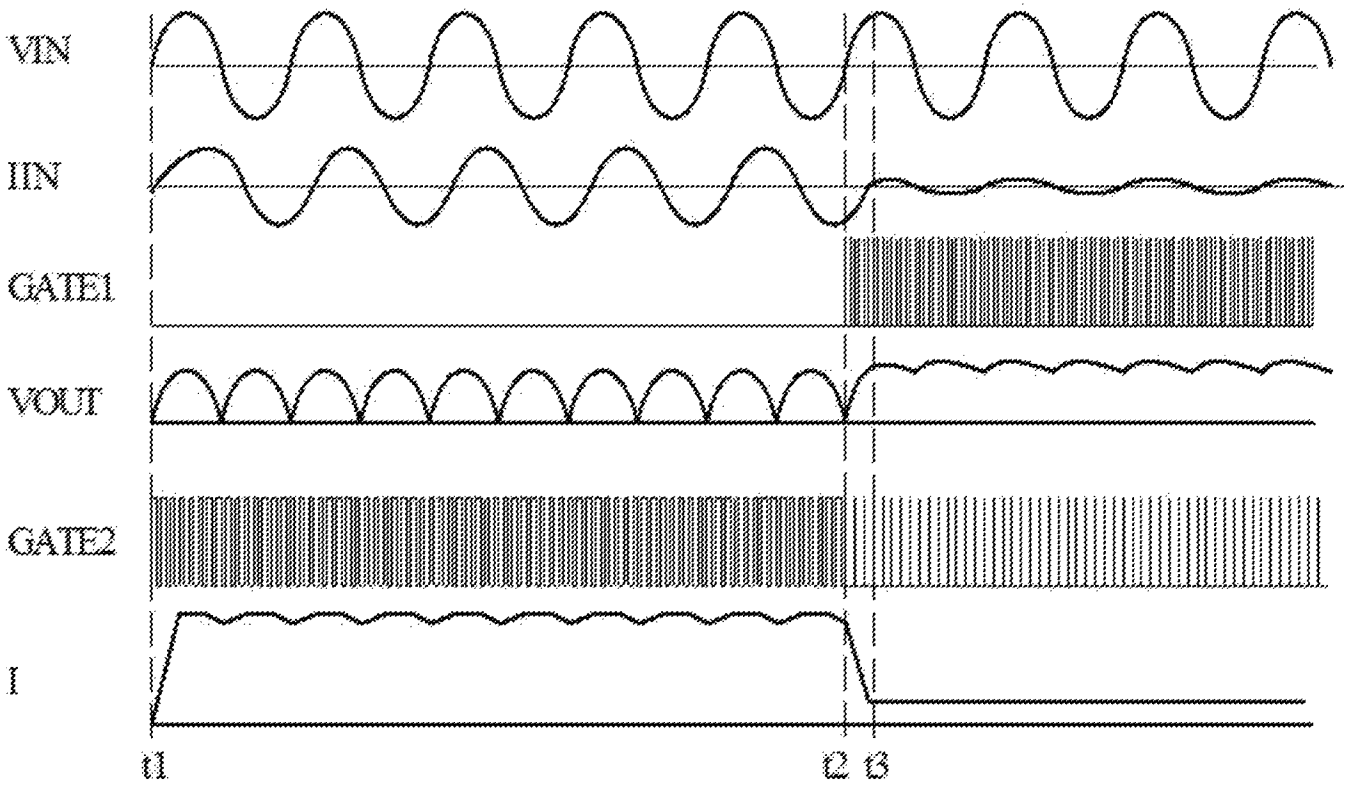
FIG. 8 is a schematic diagram of voltage and current of each part shown in the power-saving circuit of the contactor according to the first embodiment of the present invention.

The square wave generation circuit U1 includes a first pin, a second pin, a third pin, a fourth pin, and a fifth pin. The first pin is connected to the cathode of diode D1 for assisting power supply. The second pin is grounded. The third pin is connected to the gate of the N-MOS transistor Q2 for controlling the current of the contactor coil. The fourth pin is connected to the gate of the N-MOS transistor Q1 for controlling the output voltage of the PFC circuit. The fifth pin is connected to the drain electrode of the N-MOS transistor Q1 for the supply power to the square wave generation circuit when the circuit is started. As shown in FIG. 8, the timing sequence of the square wave generation circuit is as follows:

The t1~t2 interval is the contactor pull-in stage. Normally, the contactor coil pull-in current is 10~20 times the holding current. The pull-in current is controlled by the coil drive circuit. A large current is passed through the contactor coil by controlling the duty cycle of the N-MOS transistor Q2. For reasons of reduced volume and cost, the inductor L1 and the transformer T1 are designed based on the power of the holding stage, so both of which will go into a saturation state during the pull-in stage L1 and T1, and the PFC circuit will not work properly. Therefore, during this stage, the fourth pin of the square wave generation circuit does not output the square wave signal, so that the PFC circuit does not work.

The interval between t2 and t3 is in a transition state. At t2, the square wave signal of the third pin of the square wave generation circuit changes from a large duty cycle to a small duty cycle, and the contactor coil current gradually becomes smaller. At this time, the fourth pin of the square wave generation circuit also starts outputting the square wave signal.

The time after t3 is the contactor holding state. The contactor coil current is reduced to the current required to hold, and the PFC circuit starts to work normally.

The Second Embodiment

Figure 9:
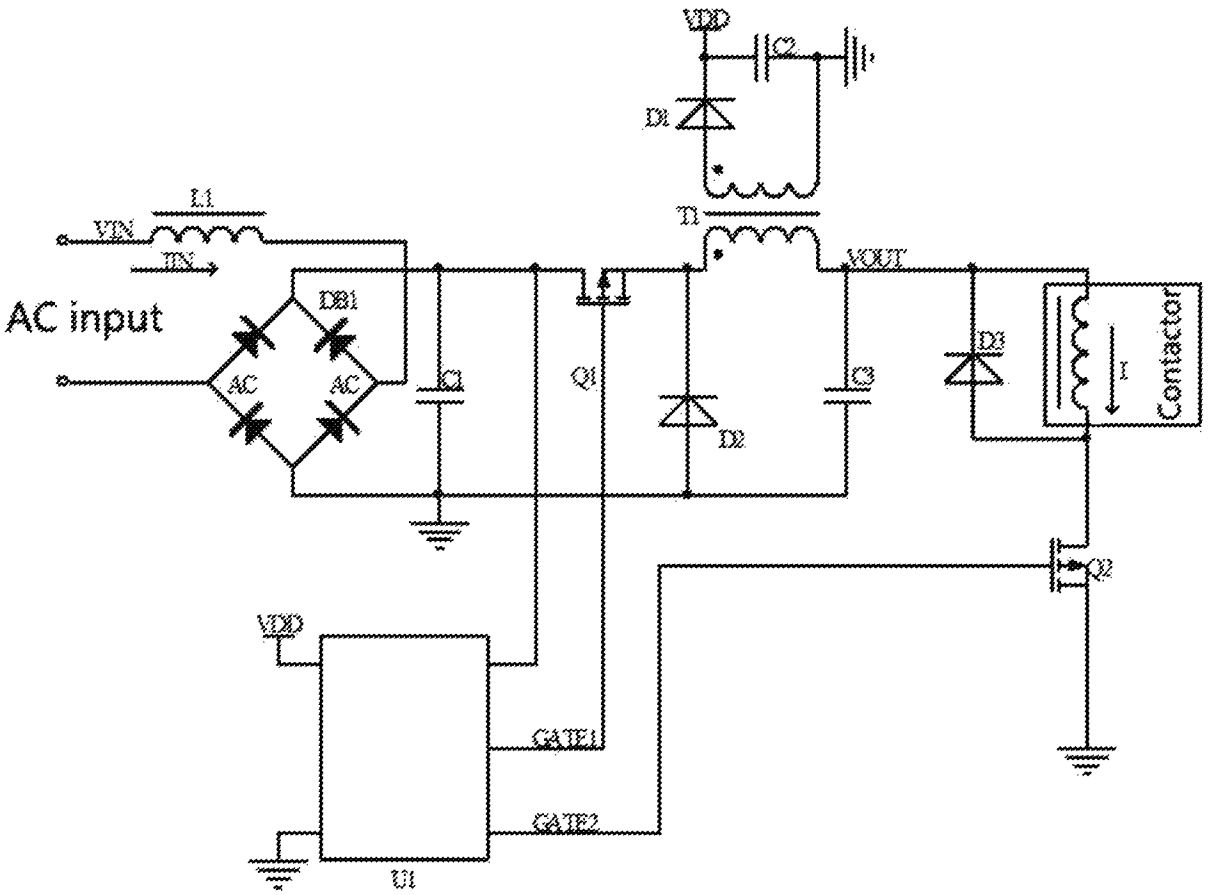
FIG. 9 is a schematic circuit diagram of a power-saving circuit for a contactor according to the second embodiment of the present invention.
Figure 10:
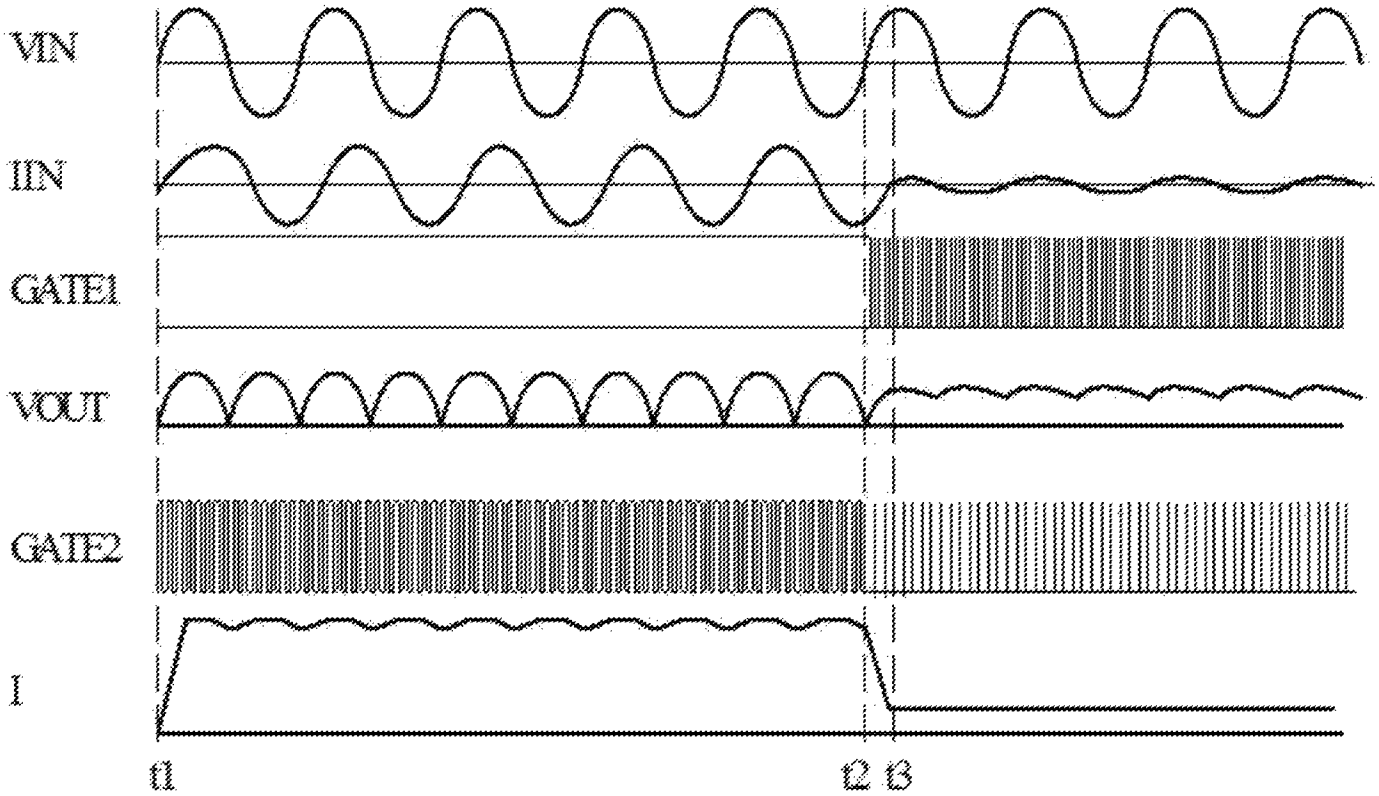
FIG. 10 is a schematic diagram of voltage and current of each part shown in the power-saving circuit of the contactor according to the second embodiment of the present invention.

FIG. 9 is a schematic circuit diagram of a power-saving circuit for a contactor according to the second embodiment of the present invention. The PFC circuit of the second embodiment is different from the PFC circuit of the first embodiment. The PFC circuit in the first embodiment is a BOOST topology, while the PFC circuit in the second embodiment is a BUCK topology. Except for the control and voltage of some nodes are different from those of the first embodiment, other circuits are not different in principle. As shown in FIG. 10, the difference from the first embodiment is as follows: the first output end of the square wave generation circuit always outputs a high level during a pull-in stage of the contactor; The PFC circuit outputs a voltage lower than the input voltage.

The above are merely preferred embodiments of the present invention. It should be pointed out that the above preferred embodiments should not be construed as limiting the present invention, and the protection scope of the present invention should be determined by the protection scope defined by the claims. It will be apparent to those skilled in the art that various modifications and improvements can be made without departing from the spirit and scope of the invention, and that these modifications and alterations should also be regarded as within the protection scope of the invention. For example, the input adopts a multi-stage LC filter, and the chip adopts an auxiliary power supply.

What is claimed is:

1. A power-saving circuit for a contactor, comprising a coil drive circuit, a rectification and filtering circuit, a power factor correction (PFC) circuit, an auxiliary power supply circuit and a square wave generation circuit, wherein the square wave generation circuit outputs a first square wave signal to the PFC circuit via a first output end according to a set timing sequence, and outputs a second square wave signal and a third square wave signal to the coil drive circuit via a second output end, so as to respectively control duty cycles of a first transistor in the PFC circuit and a second transistor in the coil drive circuit;

the auxiliary power supply circuit supplies electric energy to the square wave generation circuit during a holding stage of the contactor;

the rectification and filtering circuit is configured to rectifying an input alternating current (AC) into a pulsed direct current (DC), and filtering an input narrow-pulse current into a smooth current to be output to the PFC circuit after eliminating higher harmonic components other than a fundamental frequency component of 50 Hz;

the PFC circuit receives rectified and filtered electric energy, enables an effective value of the input current to change along with an input voltage, and outputs the input current to the coil drive circuit and the auxiliary power supply circuit;

the coil drive circuit is configured to controlling a current of a contactor coil; wherein, during a pull-in stage of the contactor, the PFC circuit is turned off and the power-saving circuit provides a large current to the contactor coil to pull in;

during a transition stage, the PFC circuit is turned on and the power-saving circuit controls the current of the contactor coil to decrease gradually; and during the holding stage of the contactor, the PFC circuit is still turned on and the power-saving circuit controls the current of the contactor coil to be kept as a small current required for holding.

2. The power-saving circuit according to claim 1, wherein:

the rectification and filtering circuit comprises an inductor, and the PFC circuit comprises a transformer, wherein, the inductor of the rectification and filtering circuit and the transformer of the PFC circuit are designed according to power of the contactor during the holding stage, and during the pull-in stage of the contactor, both the inductor and the transformer are in a saturation state.

3. The power-saving circuit according to claim 1, wherein the first transistor and the second transistor are N-type metal-oxide-semiconductor (N-MOS) transistor, and the set timing sequence of the square wave generation circuit is as follows:

during the pull-in stage of the contactor, the first output end is controlled to not output the first square wave signal to the first transistor of the PFC circuit, so that the PFC circuit is turned off; and a second square wave signal of a large duty cycle is output to the second transistor of the coil drive circuit through the second output end;

during the transition stage, the first square wave signal is output to the first transistor of the PFC circuit through the first output end, so that the PFC circuit is turned on; and a third square wave signal of a small duty cycle is output to the second transistor of the coil drive circuit through the second output end; and during the holding stage of the contactor, the first square wave signal is continuously output to the first transistor of the PFC circuit through the first output end, so as to keep the PFC circuit turned on; and the third square wave signal of a small duty cycle is continuously output to the second transistor of the coil drive circuit through the second output end, so as to control the current of the contactor coil to be kept as the small current required for holding.

4. The power-saving circuit according to claim 1, wherein the large current provided by the power-saving circuit during the pull-in stage of the contactor is 10 to 20 times the small current during the holding stage.

5. The power-saving circuit according to claim 1, wherein:

the rectification and filtering circuit comprises an inductor, a rectifying bridge and a capacitor which are connected in such a relationship that the inductor is connected in series between an input end of the AC and an input end of the rectifying bridge, and output ends of the rectifying bridge and the capacitor are connected in parallel to lead out as output ends of the rectification and filtering circuit.

6. The power-saving circuit according to claim 1, wherein the first transistor is N-type metal-oxide-semiconductor (N-MOS) transistor, and the PFC circuit comprises a transformer, the first transistor, a diode, and a capacitor, wherein the transformer comprises a primary winding and a secondary winding which are connected in such a relationship that dotted end of the primary winding is connected to an output end of the rectification and filtering circuit, non-dotted ends of the primary winding is respectively connected to drain electrode of the first transistor and an anode of the diode, a cathode of the diode is grounded via the capacitor, and the cathode of the diode is coupled as the output end of the PFC circuit; gate of the first transistor is connected to the first output end of the square wave generation circuit, and source electrode of the first transistor is grounded; and the secondary winding is connected to the auxiliary power supply circuit.

7. The power-saving circuit according to claim 1, wherein the first transistor is N-type metal-oxide-semiconductor (N-MOS) transistor, and the PFC circuit comprises a transformer, the first transistor, a diode, and a capacitor, wherein the transformer comprises a primary winding and a secondary winding which are connected in such a relationship that a drain electrode of the first transistor is connected to the output ends of the rectification and filtering circuit, and a source electrode of the first transistor is respectively connected to dotted ends of the primary winding and a cathode of the diode, and the non-dotted ends of the primary winding is grounded via the capacitor; non-dotted end of the primary winding is coupled as the output end of the PFC circuit; an anode of the diode is grounded; a gate of the first transistor is connected to the first output end of the square wave generation circuit; and the secondary winding is connected to the auxiliary power supply circuit.

8. The power-saving circuit according to claim 1, wherein: the square wave generation circuit comprises a first input end, a second input end, the first output end, and the second output end which are connected in such a relationship that the first input end is connected to the input end of the PFC circuit to provide electric energy required for first start-up of the square wave generation circuit; the second input end is connected to an output end VDD of the auxiliary power supply circuit to provide electric energy for the square wave generation circuit during the transition stage and the holding stage; the first output end is connected to the PFC circuit to output the first square wave signal to control transmission energy of the PFC circuit; and the second output end is connected to the coil drive circuit to adjust the current of the contactor coil by changing the duty cycle of the square wave signal.

9. The power-saving circuit according to claim 1, wherein the auxiliary power supply circuit is composed of a diode and a capacitor which are connected in such a relationship that an anode of the diode is connected to the PFC circuit, and a cathode of the diode is grounded via the capacitor, and the cathode of the diode is coupled to VDD of the auxiliary power supply circuit.

10. The power-saving circuit according to claim 1, wherein the second transistor is N-type metal-oxide-semiconductor (N-MOS) transistor, and the coil drive circuit is composed of a diode and the second transistor which are connected in such a relationship that a cathode of the diode is connected to the output end of the PFC circuit, and the cathode of the diode is coupled as an output positive end of the coil drive circuit to be connected to one end of the contactor coil; an anode of the diode is connected to a drain electrode of the second transistor, and the drain electrode of the second transistor is coupled as an output negative end of the coil drive circuit to be connected to the other end of the contactor coil; and a gate of the second transistor is connected to the second output end of the square wave generation circuit, and a source electrode of the second transistor is grounded.

11. The power-saving circuit according to claim 2, wherein:

the rectification and filtering circuit further comprises a rectifying bridge and a capacitor which are connected in such a relationship that the inductor is connected in series between an input end of the AC and an input end of the rectifying bridge, and output ends of the rectifying bridge and the capacitor are connected in parallel to lead out as output ends of the rectification and filtering circuit.

12. The power-saving circuit according to claim 3, wherein:

the rectification and filtering circuit comprises an inductor, a rectifying bridge and a capacitor which are connected in such a relationship that the inductor is connected in series between an input end of the AC and an input end of the rectifying bridge, and output ends of the rectifying bridge and the capacitor are connected in parallel to lead out as output ends of the rectification and filtering circuit.

13. The power-saving circuit according to claim 2, wherein the first transistor is N-type metal-oxide-semiconductor (N-MOS) transistor, and the PFC circuit further comprises the first transistor, a diode, and a capacitor, wherein the transformer comprises a primary winding and a secondary winding which are connected in such a relationship that dotted end of the primary winding is connected to the output end of the rectification and filtering circuit, non-dotted end of the primary winding is respectively connected to drain electrode of the first transistor and an anode of the diode, a cathode of the diode is grounded via the capacitor, and the cathode of the diode is coupled as the output end of the PFC circuit; gate of the first transistor is connected to the first output end of the square wave generation circuit, and source electrode of the first transistor is grounded; and the secondary winding is connected to the auxiliary power supply circuit.

14. The power-saving circuit according to claim 3, wherein the PFC circuit comprises a transformer, the first transistor, a diode, and a capacitor, wherein the transformer comprises a primary winding and a secondary winding which are connected in such a relationship that dotted end of the primary winding is connected to the output end of the rectification and filtering circuit, non-dotted end of the primary winding is respectively connected to drain electrode of the first transistor and an anode of the diode, a cathode of the diode is grounded via the capacitor, and the cathode of the diode is coupled as the output end of the PFC circuit; gate of the first transistor is connected to the first output end of the square wave generation circuit, and source electrode of the first transistor is grounded; and the secondary winding is connected to the auxiliary power supply circuit.

15. The power-saving circuit according to claim 2, wherein the first transistor is N-type metal-oxide-semiconductor (N-MOS) transistor, and the PFC circuit further comprises the first transistor, a diode and a capacitor, wherein the transformer comprises a primary winding and a secondary winding which are connected in such a relationship that a drain electrode of the first transistor is connected to the output ends of the rectification and filtering circuit, and a source electrode of the first transistor is respectively connected to dotted end of the primary winding and a cathode of the diode, and non-dotted end of the primary winding is grounded via the capacitor; the non-dotted end of the primary winding is coupled as the output end of the PFC circuit; an anode of the diode is grounded; a gate of the first transistor is connected to the first output end of the square wave generation circuit; and the secondary winding is connected to the auxiliary power supply circuit.

16. The power-saving circuit according to claim 3, wherein the PFC circuit comprises a transformer, the first transistor, a diode, and a capacitor, wherein the transformer comprises a primary winding and a secondary winding which are connected in such a relationship that a drain electrode of the first transistor is connected to the output ends of the rectification and filtering circuit, and a source electrode of the first transistor is respectively connected to dotted ends of the primary winding and a cathode of the diode, and non-dotted end of the primary winding is grounded via the capacitor; the non-dotted end of the primary winding is coupled as the output end of the PFC circuit; an anode of the diode is grounded; a gate of the first transistor is connected to the first output end of the square wave generation circuit; and the secondary winding is connected to the auxiliary power supply circuit.

17. The power-saving circuit according to claim 2, wherein:

the square wave generation circuit comprises a first input end, a second input end, the first output end, and the second output end which are connected in such a relationship that the first input end is connected to the input end of the PFC circuit to provide electric energy required for first start-up of the square wave generation circuit; the second input end is connected to an output end VDD of the auxiliary power supply circuit to provide electric energy for the square wave generation circuit during the transition stage and the holding stage; the first output end is connected to the PFC circuit to output the first square wave signal to control transmission energy of the PFC circuit; and the second output end is connected to the coil drive circuit to adjust the current of the contactor coil by changing the duty cycle of the square wave signal.

18. The power-saving circuit according to claim 3, wherein:

the square wave generation circuit comprises a first input end, a second input end, the first output end, and the second output end which are connected in such a relationship that the first input end is connected to the input end of the PFC circuit to provide electric energy required for first start-up of the square wave generation circuit; the second input end is connected to an output end VDD of the auxiliary power supply circuit to provide electric energy for the square wave generation circuit during the transition stage and the holding stage; the first output end is connected to the PFC circuit to output the first square wave signal to control transmission energy of the PFC circuit; and the second output end is connected to the coil drive circuit to adjust the current of the contactor coil by changing the duty cycle of the square wave signal.

19. The power-saving circuit according to claim 2, wherein the second transistor is N-type metal-oxide-semiconductor (N-MOS) transistor, and the coil drive circuit is composed of a diode and the second transistor which are connected in such a relationship that a cathode of the diode is connected to the output end of the PFC circuit, and the cathode of the diode is coupled as an output positive end of the coil drive circuit to be connected to one end of the contactor coil; an anode of the diode is connected to a drain electrode of the second transistor, and the drain electrode of the second transistor is coupled as an output negative end of the coil drive circuit to be connected to the other end of the contactor coil; and a gate of the second transistor is connected to the second output end of the square wave generation circuit, and a source electrode of the second transistor is grounded.

20. The power-saving circuit according to claim 3, wherein the coil drive circuit is composed of a diode and the second transistor which are connected in such a relationship that a cathode of the diode is connected to the output end of the PFC circuit, and the cathode of the diode is coupled as an output positive end of the coil drive circuit to be connected to one end of the contactor coil; an anode of the diode is connected to a drain electrode of the second transistor, and the drain electrode of the second transistor is coupled as an output negative end of the coil drive circuit to be connected to the other end of the contactor coil; and a gate of the second transistor is connected to the second output end of the square wave generation circuit, and a source electrode of the second transistor is grounded.

* * * * *